US009216584B2

(12) United States Patent
Moriguchi

(10) Patent No.: US 9,216,584 B2
(45) Date of Patent: Dec. 22, 2015

(54) PRINTER

(71) Applicant: Funai Electric Co., Ltd., Osaka (JP)

(72) Inventor: Tetsuya Moriguchi, Takatsuki (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/610,064

(22) Filed: Jan. 30, 2015

(65) Prior Publication Data

US 2015/0217574 A1 Aug. 6, 2015

(30) Foreign Application Priority Data

Jan. 31, 2014 (JP) ..... 2014-017342

(51) Int. Cl.
*B41J 25/308* (2006.01)
*B41J 25/316* (2006.01)
*B41J 2/175* (2006.01)

(52) U.S. Cl.
CPC ..... *B41J 2/1752* (2013.01); *B41J 25/3082* (2013.01); *B41J 25/316* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 5,700,095 | A * | 12/1997 | Sugiyama | 400/55 |
| 6,059,392 | A * | 5/2000 | Park | 347/8 |
| 6,543,868 | B2 * | 4/2003 | Cooper et al. | 347/8 |
| 7,063,468 | B2 * | 6/2006 | Youn et al. | 400/59 |
| 2008/0024530 | A1 * | 1/2008 | Schalk et al. | 347/8 |

FOREIGN PATENT DOCUMENTS

| | | | | |
|---|---|---|---|---|
| EP | 2368717 | A2 | 9/2011 | |
| JP | 09-254472 | * | 1/1997 | B41J 13/02 |
| JP | 11-106090 | * | 4/1999 | B41J 25/308 |
| JP | 2001-071581 | A | 3/2001 | |
| JP | 2013-163299 | * | 8/2013 | B41J 25/308 |

OTHER PUBLICATIONS

Computer-generated translation of Nakayama JP -09254472, published on Jan. 1997.*
Extended European Search Report issued in corresponding European Application No. 15153370.0, mailed Jun. 25, 2015 (6 pages).

* cited by examiner

*Primary Examiner* — Huan Tran
(74) *Attorney, Agent, or Firm* — Osha Liang LLP

(57) ABSTRACT

A printer includes a carriage mounted with a head including a nozzle that discharges ink onto a recording medium, a lever including a first end that contacts a surface of the recording medium. The lever is disposed such that an inclination of the lever relative to a vertical direction of the surface changes based on a thickness of the recording medium. The printer further includes a cam that changes an orientation of the carriage based on the inclination of the lever.

20 Claims, 20 Drawing Sheets

PRINTER

TECHNICAL FIELD

The present invention relates generally to a printer that can adjust a gap between a nozzle that discharges ink and a recording medium of a sheet shape.

BACKGROUND

There are various thicknesses to recording mediums (for example, paper, label surfaces of disc media, and the like) of a sheet shape used with inkjet printers. If a thickness of a recording medium changes, a distance from a nozzle that discharges ink to the recording medium (also referred to as a "paper gap" below) also fluctuates. Moreover, the paper gap also fluctuates due to variations in component sizes and the like. Moreover, the fluctuations in the paper gap lead to reductions in print quality.

In contrast, in Patent Literature 1, adjustor motor moves a carriage vertically according to a gap detected using a detection lever. By this, an appropriate gap is set.

CITATION LIST

Patent Literature

[Patent Literature 1] Japanese Unexamined Patent Application Publication No. 2001-71581

However, in the conventional technology, a motor for adjusting the gap is necessary, complicating the structure of the printer.

SUMMARY

One or more embodiments of the present invention provide a printer that can adjust a gap between a nozzle and a recording medium by a simple configuration.

For example, a printer according to one or more embodiments of the present invention may be a printer that can adjust a gap between a recording medium of a sheet shape and a nozzle that discharges ink onto the recording medium, provided with: a carriage mounted with a head having the nozzle; a lever that is installed so one end thereof contacts a surface of the recording medium and whose inclination changes according to a thickness of the recording medium; and a cam that is connected to another end of the lever, is a cam whose rotational angle changes according to the inclination of the lever, and adjusts the gap by changing an attitude of the carriage according to the change in the rotational angle.

According to one or more embodiments of this configuration, the inclination of the lever changes according to the thickness of the recording medium, the rotational angle of the cam changes according to the inclination of the lever, and the attitude of the carriage changes according to the rotational angle of the cam. That is, the attitude of the carriage can be changed according to the thickness of the recording medium, and the gap between the nozzle and the recording medium can be appropriately maintained even if the thickness of the recording medium changes. That is, the gap between the nozzle and the recoding medium can be adjusted by a simple configuration without using a drive source for adjusting the gap.

For example, according to one or more embodiments, the cam may have a groove portion formed in a circumferential direction so a distance relative to a rotational center of the cam changes, and another end of the lever may be inserted in the groove portion of the cam.

According to one or more embodiments of this configuration, the other end of the lever is inserted in the groove portion formed in the circumferential direction of the cam so the distance relative to the rotational center of the cam changes. This means that when the inclination of the lever changes, the other end of the lever attempts to move relatively along the groove portion to a position corresponding to a distance between the other end of the lever and the rotational center of the cam. However, because the other end of the lever cannot move freely along the groove portion, the cam rotates. In this manner, by the groove portion formed in the cam, the rotational angle of the cam can be changed according to the inclination of the lever by a simpler configuration, and the gap between the nozzle and the recording medium can be adjusted.

For example, according to one or more embodiments, the printer may be further provided with a connecting member that is connected to a position shifted from the rotational center of the cam and changes the attitude of the carriage according to the rotational angle of the cam.

According to one or more embodiments of this configuration, the connecting member is connected to the position shifted from the rotational center of the cam. Therefore, if the cam rotates, the connecting member moves around the rotational center of the cam, and the attitude of the carriage can be changed.

For example, according to one or more embodiments, the printer may be further provided with a guide shaft that guides movement of the carriage in a predetermined direction, and a frame that supports the guide shaft; wherein a rotational shaft portion of the cam is inserted in a groove extending in the predetermined direction formed in an upper surface of the frame so as to be movable in the predetermined direction and rotatable.

According to one or more embodiments of this configuration, the rotational shaft portion of the cam is inserted in the groove extending in the predetermined direction formed in the upper surface of the frame so as to be movable in the predetermined direction and rotatable. Therefore, the cam can change the rotational angle according to the thickness of the recording medium while moving in the predetermined direction along with the carriage.

For example, according to one or more embodiments, the lever may be provided with a protruding portion that protrudes in a direction orthogonal to a longitudinal direction, and the printer may be further provided with a sensor that detects a presence or absence of the recording medium by sensing whether the protruding portion is present in a predetermined position.

According to one or more embodiments of this configuration, the lever for adjusting the gap can be used to further detect the presence or absence of the recording medium.

The printer according to one or more embodiments of the present invention can adjust the gap between the nozzle and the recording medium by the simple configuration.

DESCRIPTION OF EMBODIMENTS

Embodiments will be specifically described below with reference to drawings.

Each embodiment that will be described below illustrates a comprehensive or specific example. Numeric values, shapes, materials, components, disposition positions of the components, connection modes, and the like illustrated in the embodiments below are but examples and are not intended to limit the scope of the claims. Moreover, among the components in the embodiments below, those not described in the independent claims will be described as optional components.

A printer according to one or more embodiments of the present invention is provided with a lever that is installed to a carriage so an inclination of the lever changes according to a thickness of a recording medium of a sheet shape, and a cam whose rotational angle changes according to the inclination of the lever. Moreover, an orientation of the carriage changes according to the change in the rotational angle of the cam. By this, a gap between a nozzle and the recording medium is adjusted according to the thickness of the recording medium. Such a printer according to one or more embodiments of the present invention will be specifically described below while referencing the drawings.

[External Structure of Printer]

Figure 1:
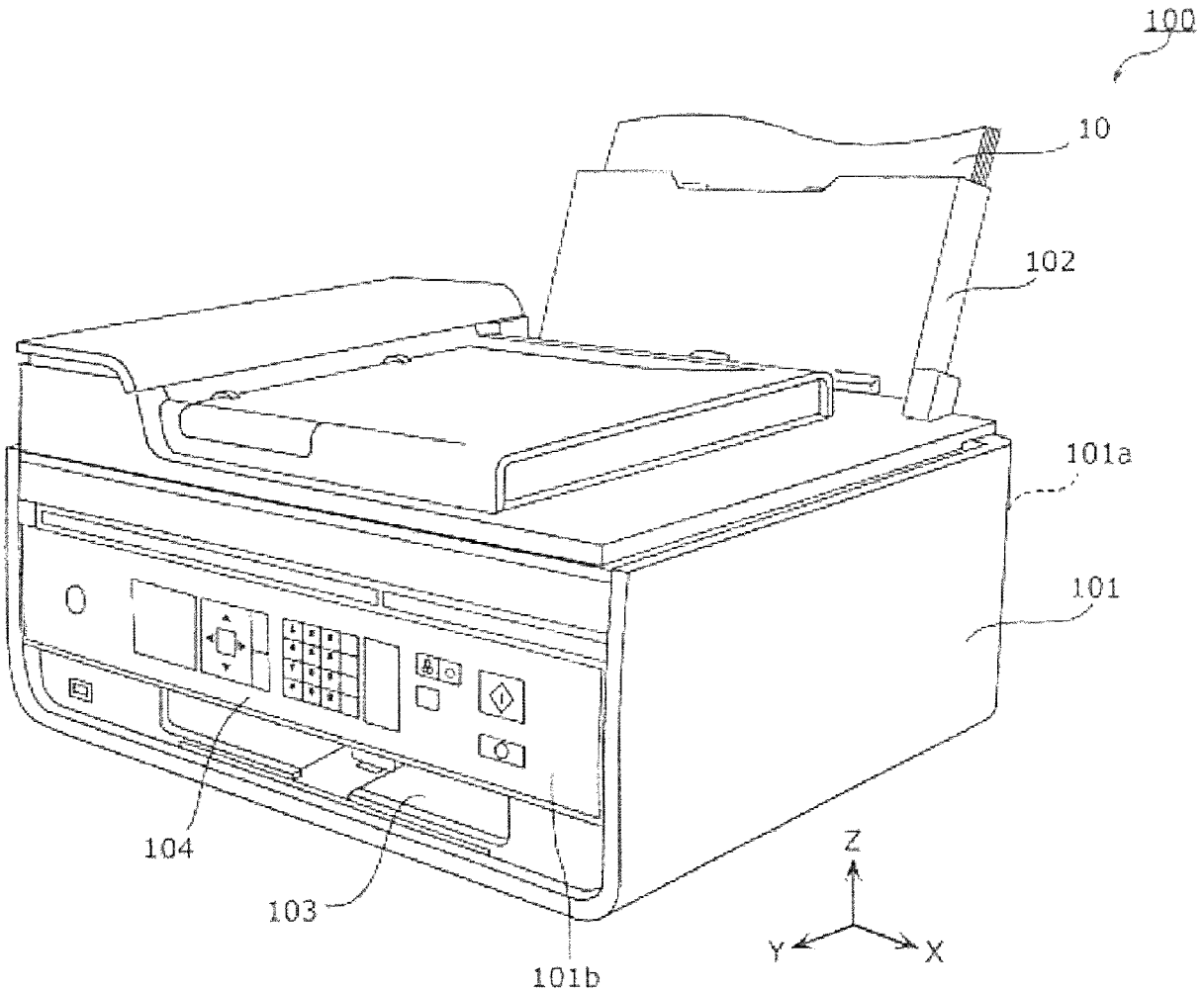
[FIG. 1] This is a perspective view illustrating an appearance of a printer according to an embodiment.

First, an external structure of the printer according to one or more embodiments will be described while referencing FIG. 1. FIG. 1 is a perspective view illustrating an appearance of the printer according to one or more embodiments of the present invention.

A printer 100 comprises a casing 101. A paper feed tray 102 for setting a recording medium 10 before printing is provided in a rear panel 101*a* of the casing 101. The recording medium 10 is paper (for example, normal paper, photographic paper, or the like), a label surface for disc media (for example, a CD, a DVD, a Blu-ray [registered trademark] disc, or the like), or the like.

A paper discharge tray 103 into which a printed recording medium 10 is discharged is provided in a front panel 101*b* of the casing 101. Moreover, an operation unit 104 for accepting various operations from a user is provided in the front panel 101*b* of the casing 101.

[Internal Structure of Printer]

Figure 2:
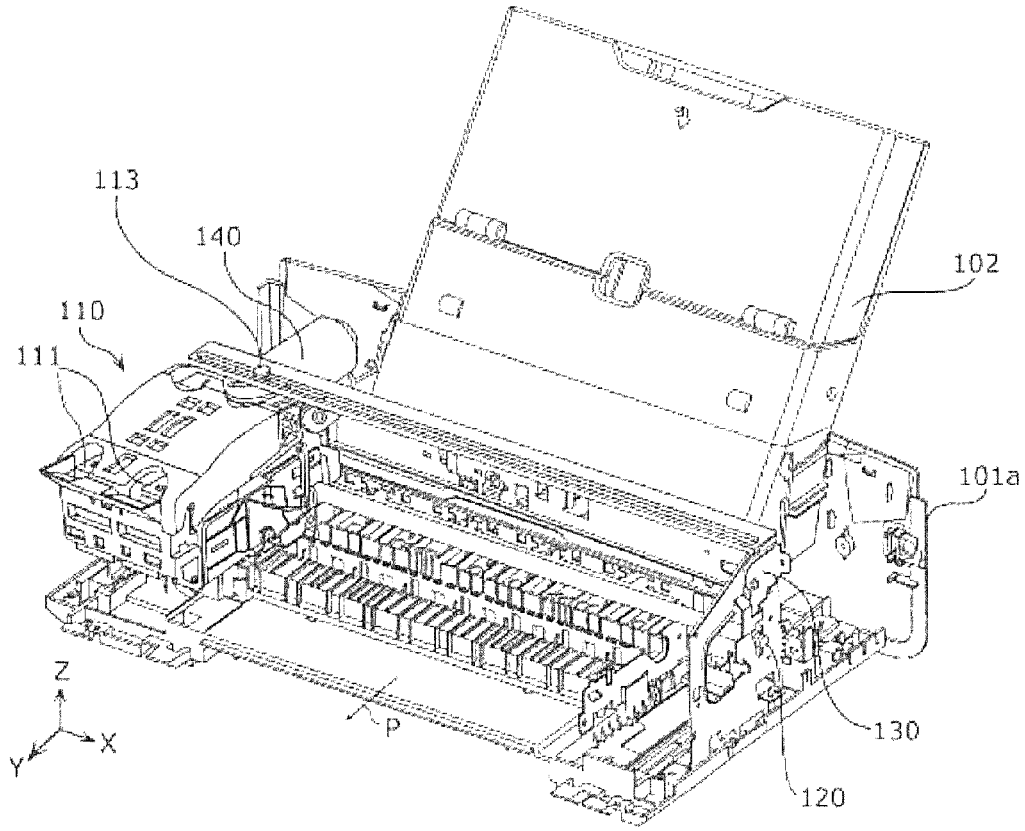
[FIG. 2] This is a perspective view illustrating an internal structure of the printer according to the embodiment.
Figure 3:
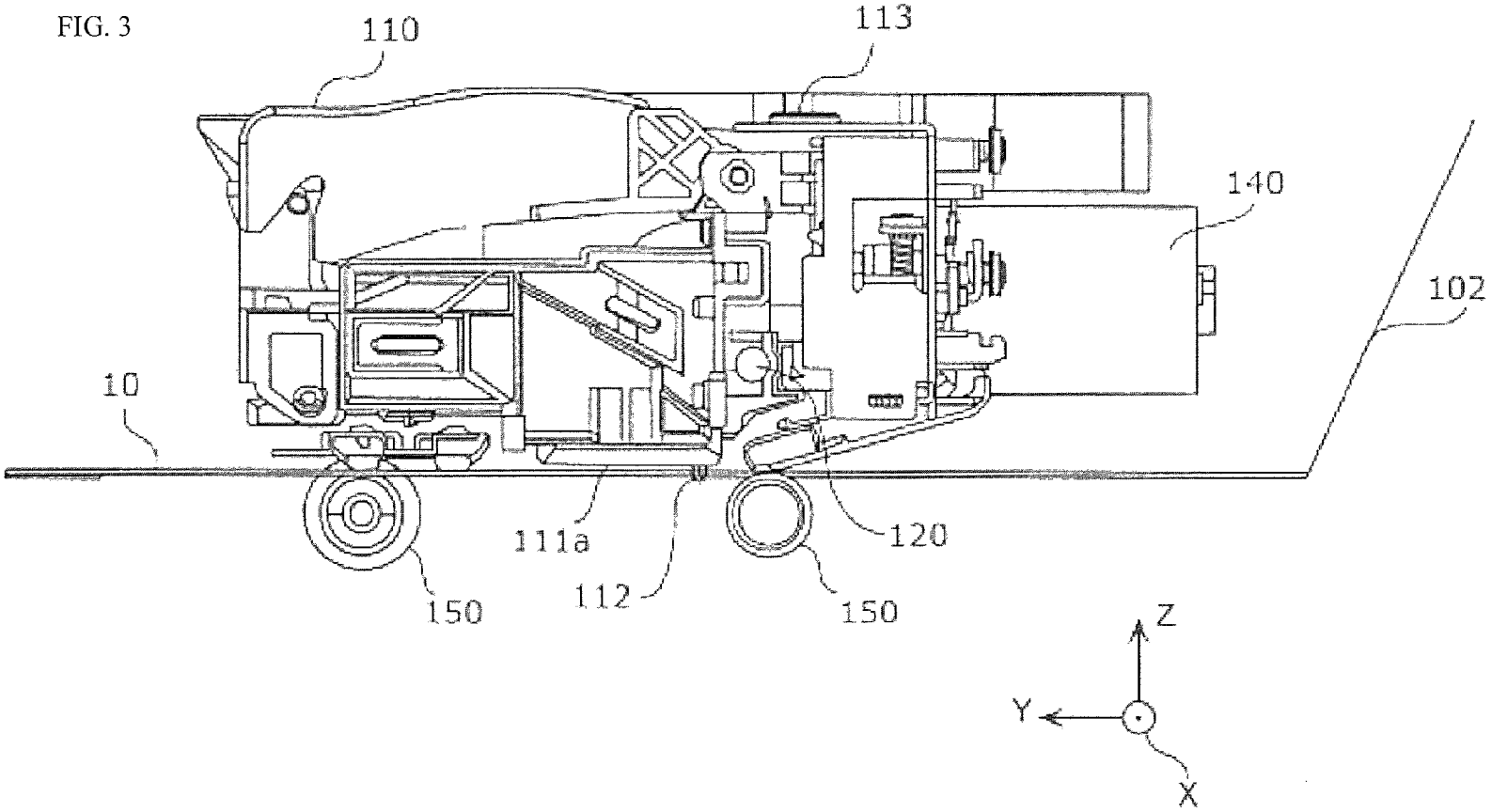
[FIG. 3] This is a partial side view illustrating a carriage vicinity of the printer according to the embodiment.

Next, an internal structure of the printer will be described while referencing FIGS. 2 and 3. FIG. 2 is a perspective view illustrating the internal structure of the printer according to one or more embodiments of the present invention. Moreover, FIG. 3 is a partial side view illustrating a carriage vicinity of the printer according to one or more embodiments of the present invention. In FIGS. 2 and 3, illustration of several components is omitted. This is to prevent the drawings from becoming needlessly complex.

As illustrated in FIG. 2, the printer 100 comprises a carriage 110, a guide shaft 120, a frame 130, and a motor 140 inside the casing 101.

A plurality of heads 111 is mounted to the carriage 110. Each of the plurality of heads 111 has a nozzle 111*a* for discharging ink. Moreover, ink cartridges of black, cyan, magenta, and yellow are loaded to the plurality of heads 111.

When printing an image on the recording medium 10, the carriage 110 is driven by the motor 140 and reciprocates along the guide shaft 120 extending in an X-axis direction. Moreover, the recording medium 10 is conveyed in a direction (Y-axis direction) indicated by arrow P in FIG. 2 by a conveyance roller 150 disposed inside the casing 101. At this time, the image is printed on the recording medium 10 by the ink being discharged toward the recording medium 10 from the nozzles 111*a* of each head 111.

A lever 112 is installed to the carriage 110. Moreover, the lever 112 is connected to a cam 113. The lever 112 and the cam 113 move in the X-axis direction along with the carriage 110. Details concerning the lever 112 and the cam 113 will be described using the drawings.

The guide shaft 120 extends in a direction (X-axis direction) substantially orthogonal to a conveyance direction (Y-axis direction) of the recording medium 10 and guides movement of the carriage 110 in the X-axis direction. For example, the guide shaft 120 is a rod member made of metal that penetrates the carriage 110 and has a cross section of a circular shape.

The frame 130 supports the guide shaft 120. Specifically, the guide shaft 120 is inserted into a hole formed in a side surface of the frame 130. Moreover, a rotational shaft portion of the cam 113 for adjusting the gap is inserted in a groove formed in an upper surface of the frame 130 so as to be movable in the X-axis direction and rotatable.

The motor 140 is an example of a drive source. The motor 140 reciprocates the carriage 110 in the X-axis direction via a power transmission mechanism (not illustrated) such as a gear or a belt by rotating in a positive direction and a reverse direction.

[Details of Lever and Cam]

Figure 4:
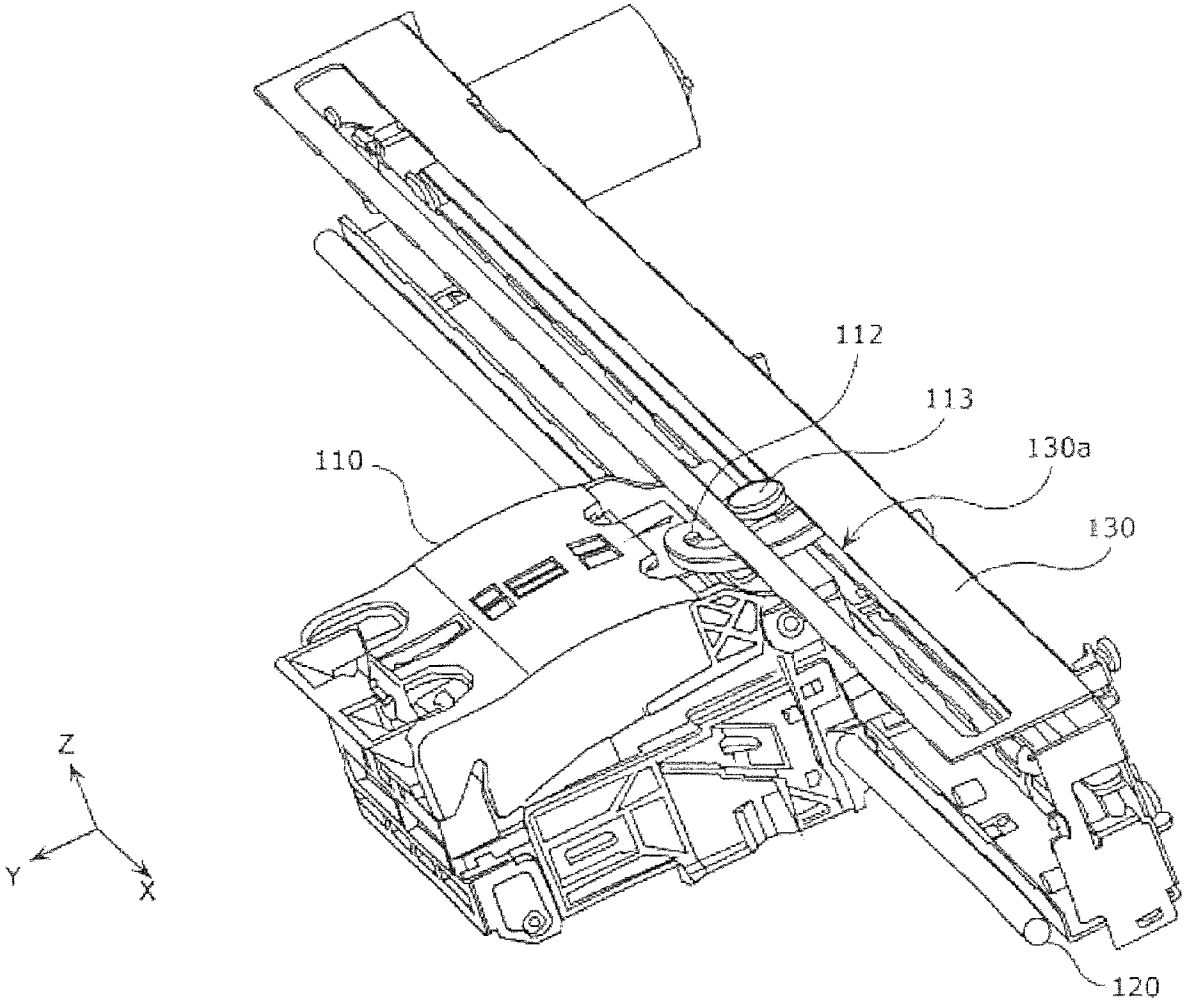
[FIG. 4] This is a partial perspective view illustrating the carriage vicinity of the printer according to the embodiment.
Figure 5:
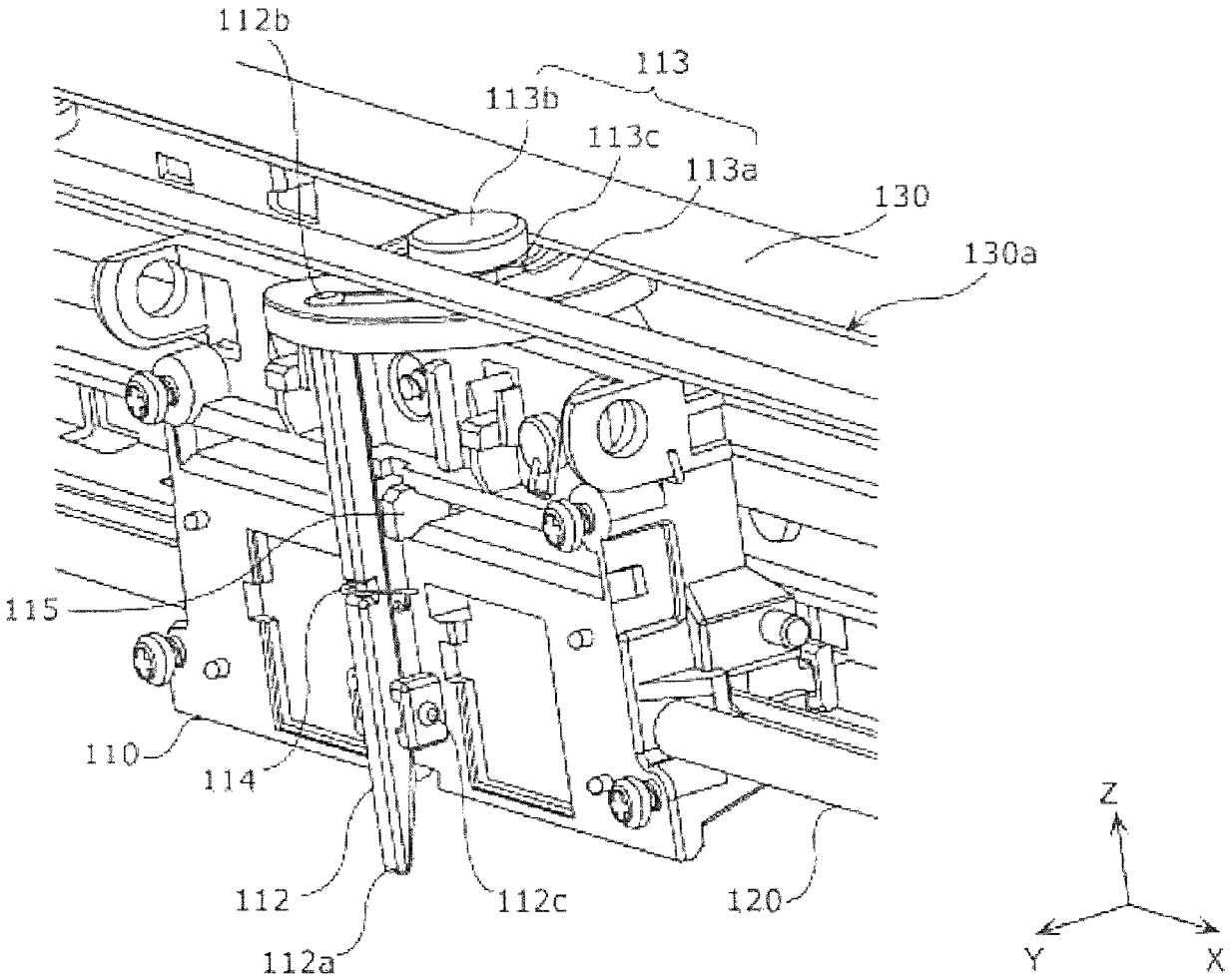
[FIG. 5] This is a partial perspective view illustrating a lever and a cam of the printer according to the embodiment.
Figure 6:
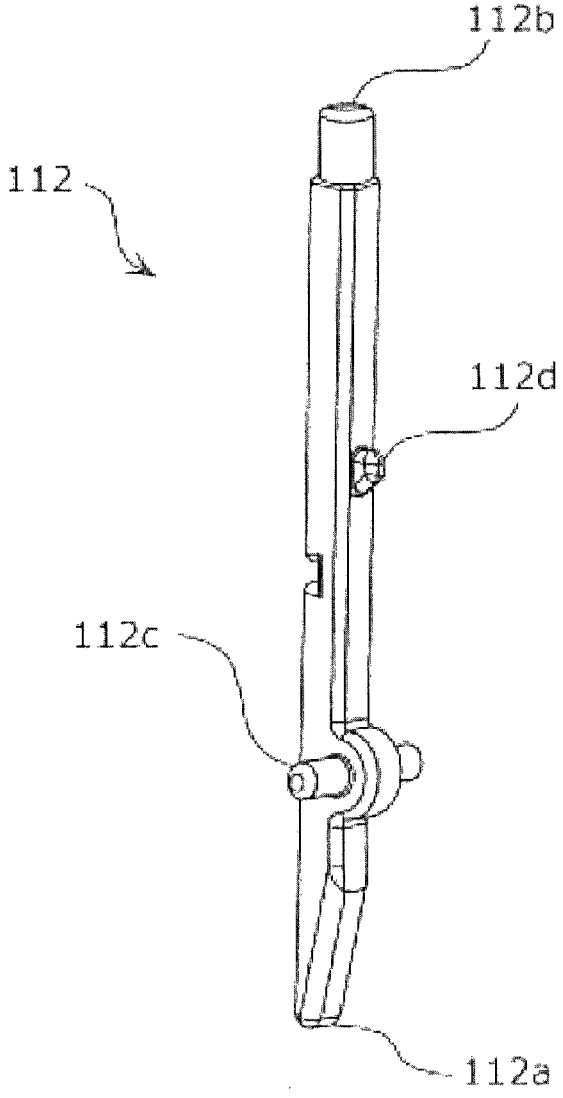
[FIG. 6] This is a perspective view of the lever according to the embodiment.
Figure 7:
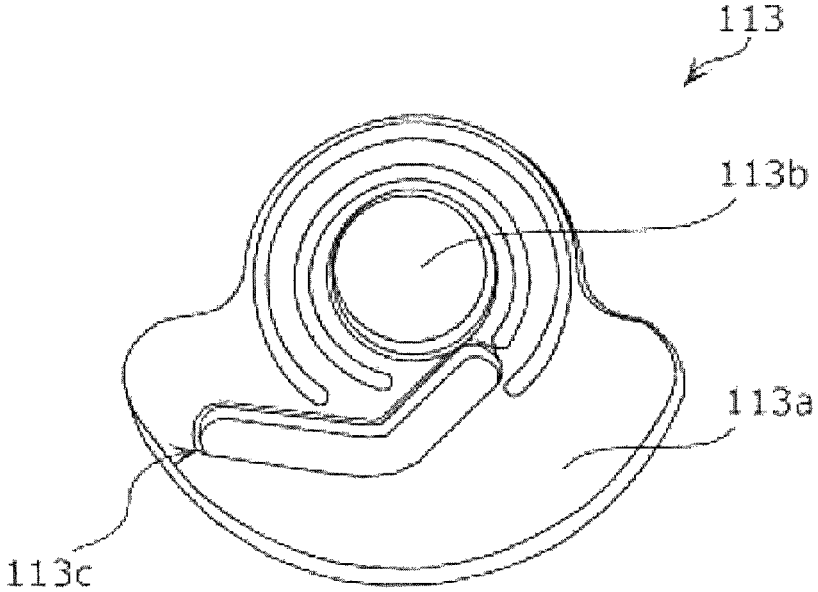
[FIG. 7] This is a perspective view of the cam according to the embodiment.

Next, the lever and the cam will be described while referencing FIGS. 4 to 8. FIG. 4 is a partial perspective view illustrating the carriage vicinity of the printer according to one or more embodiments of the present invention. FIG. 5 is a partial perspective view illustrating the lever and the cam of the printer according to one or more embodiments of the present invention. Note that in FIG. 5, a state is illustrated where a portion of the carriage is removed to expose the lever. FIG. 6 is a perspective view of the lever according to one or more embodiments of the present invention. FIG. 7 is a perspective view of the cam relating to the embodiment.

As illustrated in FIG. 5, the lever 112 is installed to the carriage 110. This lever 112 is installed so one end (lower end 112*a*) of the lever 112 contacts a surface of the recording medium 10 when the recording medium 10 passes below. Another end (upper end 112*b*) of the lever 112 is connected to the cam 113.

Furthermore, the lever 112 is installed so an inclination of the lever 112 changes according to the thickness of the recording medium 10 (i.e., thickness between a surface of the paper feed tray 102 and a top surface of the recording medium 10). Specifically, the lever 112 is supported in a rotatable manner by the carriage 110 via a rotational shaft 112*c* formed on the lever 112. Therefore, if the thickness of the recording medium 10 changes, the lever 112 rotates around the rotational shaft 112*c*, and an inclination relative to the recording medium 10 changes. The thickness of the recording medium may change, e.g., if the recording medium is paper, the thickness changes based on the number of sheets of paper).

A spring 114 biases the lever 112 in a counterclockwise manner seen from a positive direction (right side) of the X axis. That is, the spring 114 biases the lower end 112*a* of the lever 112 in a direction approaching the surface of the recording medium 10. By this, the lower end 112*a* of the lever 112 can be prevented from separating from the surface of the recording medium 10 if the thickness of the recording medium 10 is reduced.

As illustrated in FIG. 6, the lever 112 is formed with a protruding portion 112*d* that protrudes in a direction orthogonal to a longitudinal direction of the lever. A sensor 115 illustrated in FIG. 5 detects a presence or absence of the recording medium 10 by sensing whether this protruding portion 112*d* is present in a predetermined position. Specifically, the sensor 115 is, for example, a photo interrupter having a light-emitting portion and a light-receiving portion. The sensor 115 is disposed so a light emitted from the light-emitting portion to the light-receiving portion is blocked by the protruding portion 112*d* when the recording medium 10 is not present.

As illustrated in FIGS. 4, 5, and 7, the cam 113 is formed with a rotational shaft portion 113*b* with a circular cross section that protrudes from a main body portion 113*a*. This rotational shaft portion 113*b* is inserted in the groove 130*a* extending in the X-axis direction formed in the frame 130 so as to be movable in the X-axis direction and rotatable.

Furthermore, the cam 113 is connected to the upper end 112*b* of the lever 112, and the rotational angle thereof changes according to the inclination of the lever 112. Specifically, a groove portion 113*c* is formed in a circumferential direction of the main body portion 113*a* of the cam 113 so a distance relative to a rotational center of the rotational shaft portion 113*b* changes. Moreover, the upper end 112*b* of the lever 112 is inserted in this groove portion 113*c*.

Therefore, when the inclination of the lever 112 changes, the upper end 112*b* of the lever 112 attempts to move relatively along the groove portion 113*c* to a position corresponding to a distance between the upper end 112*b* of the lever 112 and the rotational center of the cam 113. However, because the upper end 112*b* of the lever 112 cannot move freely along the groove portion 113*c*, the cam 113 rotates to a rotational angle corresponding to the distance between the upper end 112*b* of the lever 112 and the rotational center of the cam 113.

Figure 8:
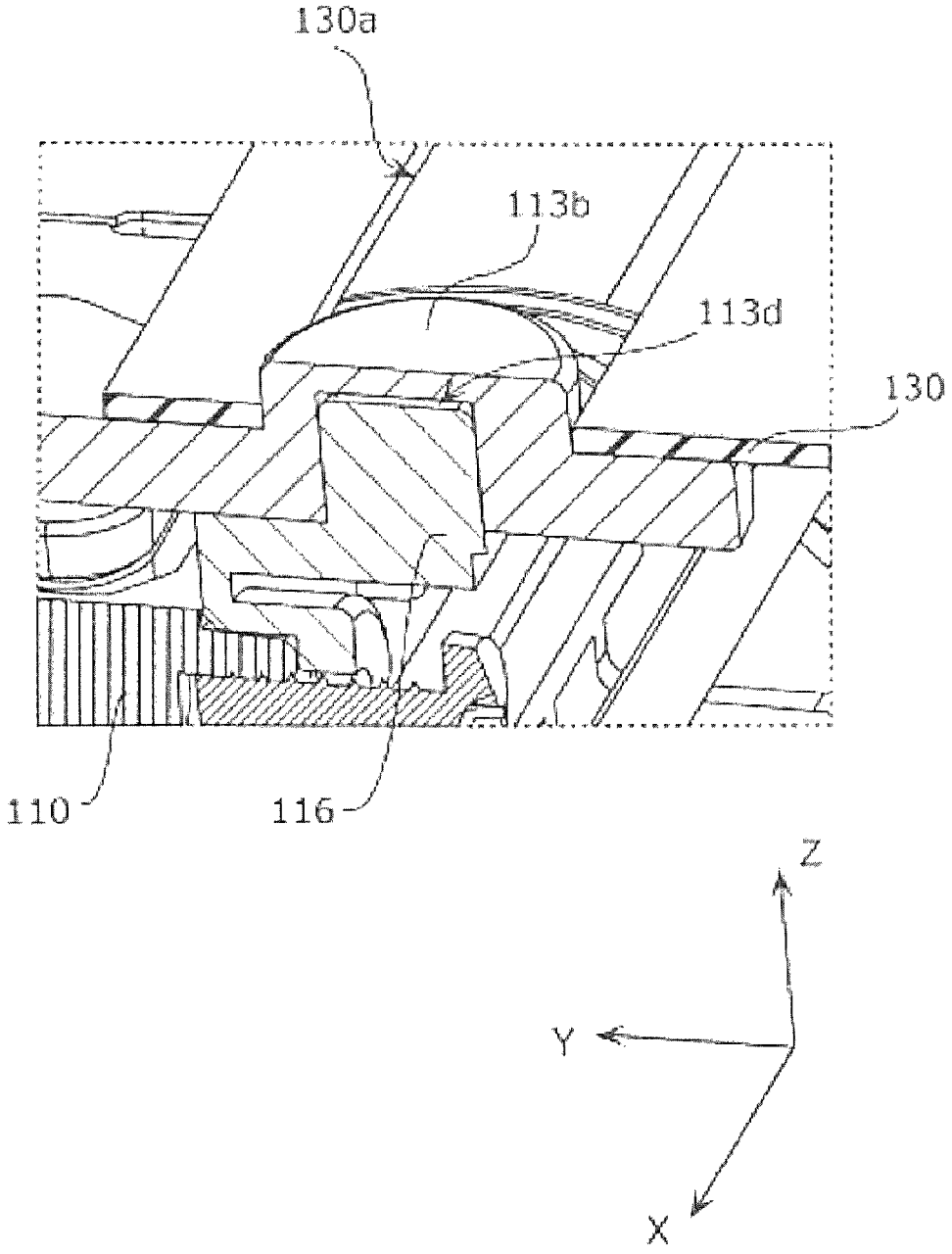
[FIG. 8] This is a cross-sectional view illustrating an internal structure of the cam according to the embodiment.

Here, an internal structure of the cam 113 for changing the orientation of the carriage 110 will be described. FIG. 8 is a cross-sectional view illustrating the internal structure of the cam according to one or more embodiments of the present invention.

As illustrated in FIG. 8, the cam 113 is formed with a concave portion 113*d* of a circular shape in a position shifted from the rotational center of the rotational shaft portion 113*b*. A connecting member 116 is inserted into this concave portion 113. That is, the connecting member 116 is connected in a rotatable manner in the position shifted from the rotational center of the cam 113.

Therefore, if the cam 113 rotates, the connecting member 116 revolves around the rotational center of the cam 113 while spinning. That is, if the cam 113 rotates, a position in the Y-axis direction of the connecting member 116 changes, and thus the orientation of the carriage 110 changes. That is, the connecting member 116 changes the orientation of the carriage 110 according to the rotational angle of the cam 113.

In the present embodiment, the carriage 110 is biased in a clockwise manner relative to the guide shaft 120 seen from the positive direction (right side) of the X-axis by a spring or the like that is not illustrated. Therefore, if the connecting member 116 moves in a negative direction of the Y axis, the carriage 110 also rotates in the clockwise manner in conjunction thereto. Conversely, if the connecting member 116 moves in the positive direction of the Y axis, an upper portion of the carriage 110 is pushed out by the connecting member 116 and the carriage 110 rotates in the counterclockwise manner.

[Operation of Printer]

Next, an operation of the printer for gap adjustment will be described while referencing FIGS. 9A to 12C. Note that below, a state where the recording medium is not present below the carriage will be referred to as a first state, a state where a recording medium 10*a* of a first thickness is present will be referred to as a second state, and a state where a recording medium 10*b* of a second thickness that is greater than the first thickness will be referred to as a third state.

Figure 9A:
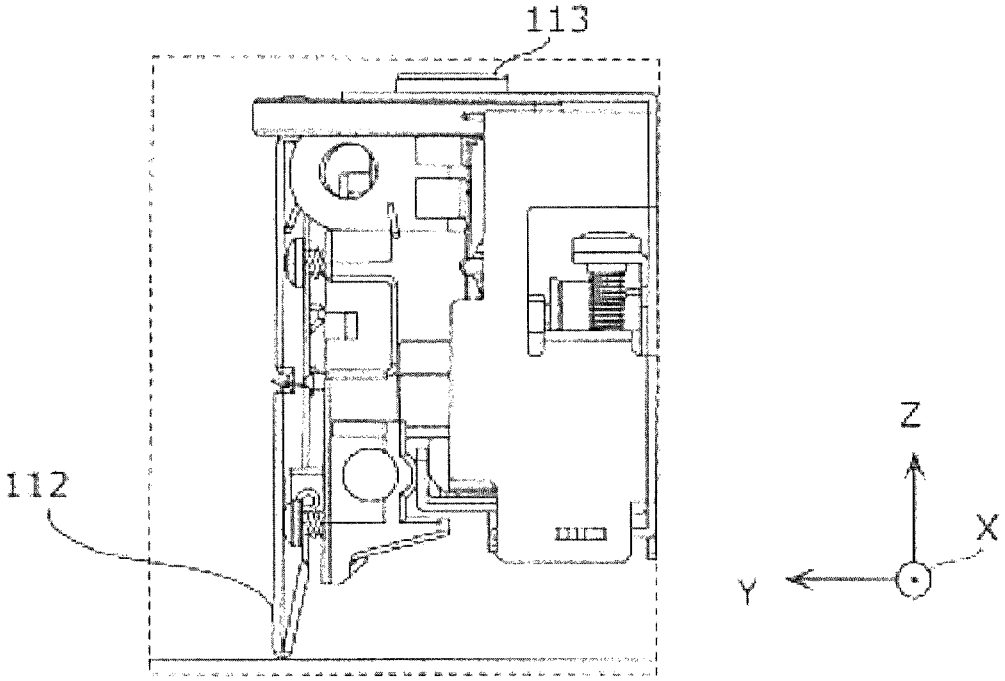
[FIG. 9A] This is a partial side view illustrating the carriage vicinity in a first state.
Figure 9B:
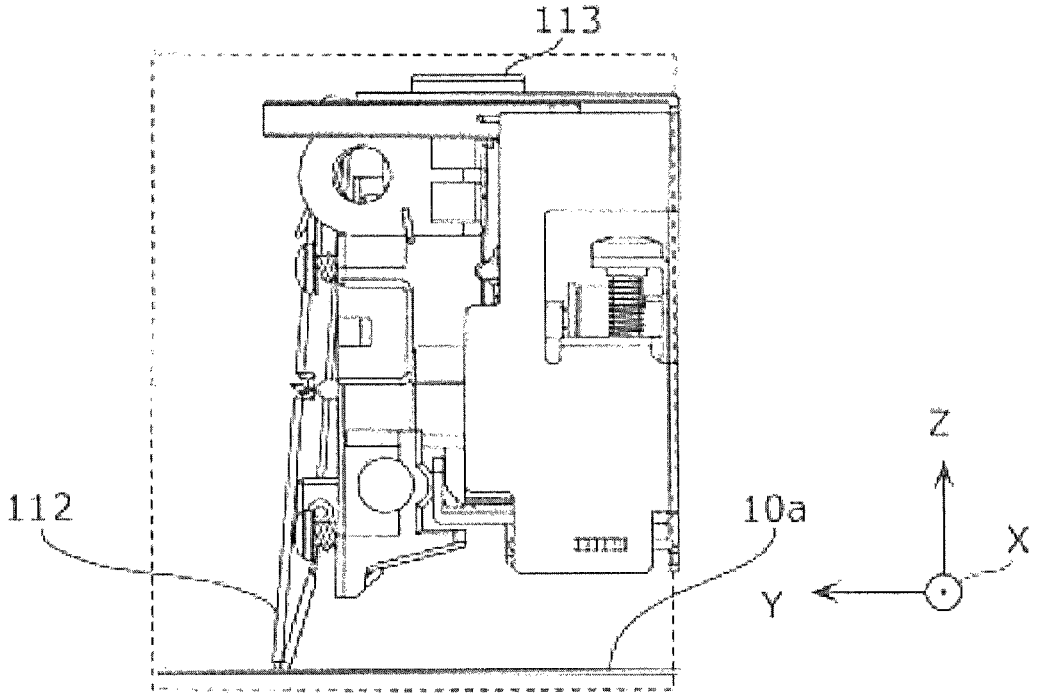
[FIG. 9B] This is a partial side view illustrating the carriage vicinity in a second state.
Figure 9C:
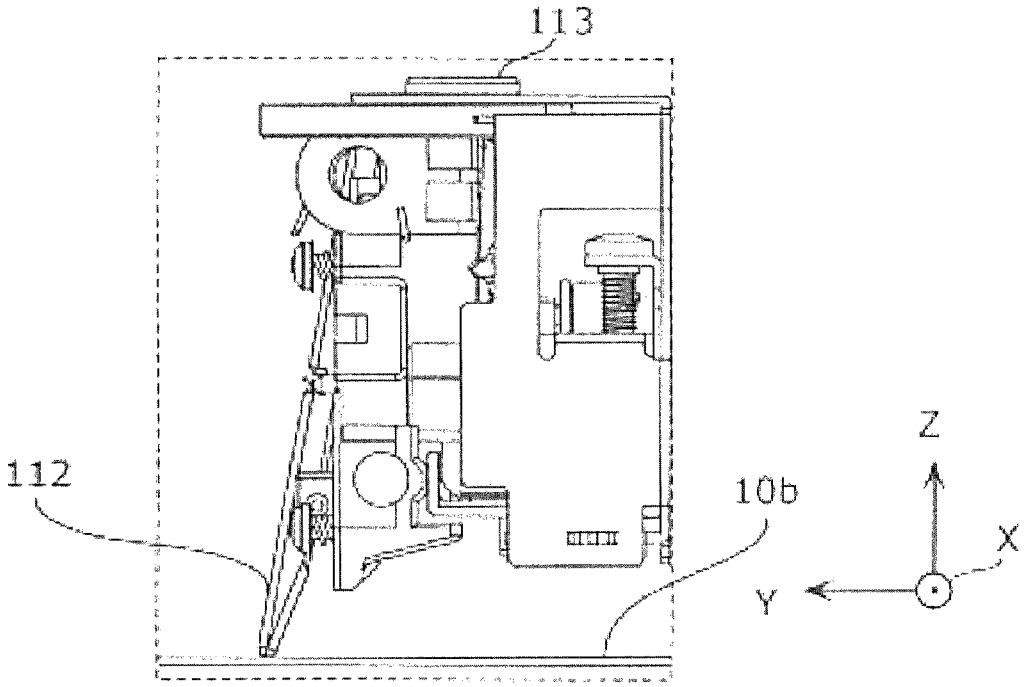
[FIG. 9C] This is a partial side view illustrating the carriage vicinity in a third state.
Figure 10A:
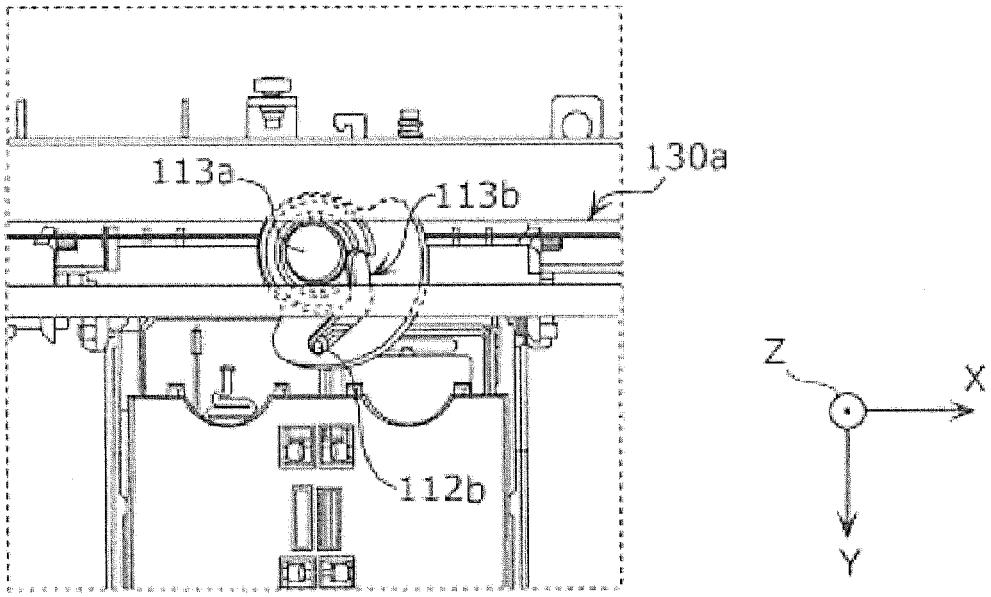
[FIG. 10A] This is a partial plan view illustrating the carriage vicinity in the first state.
Figure 10B:
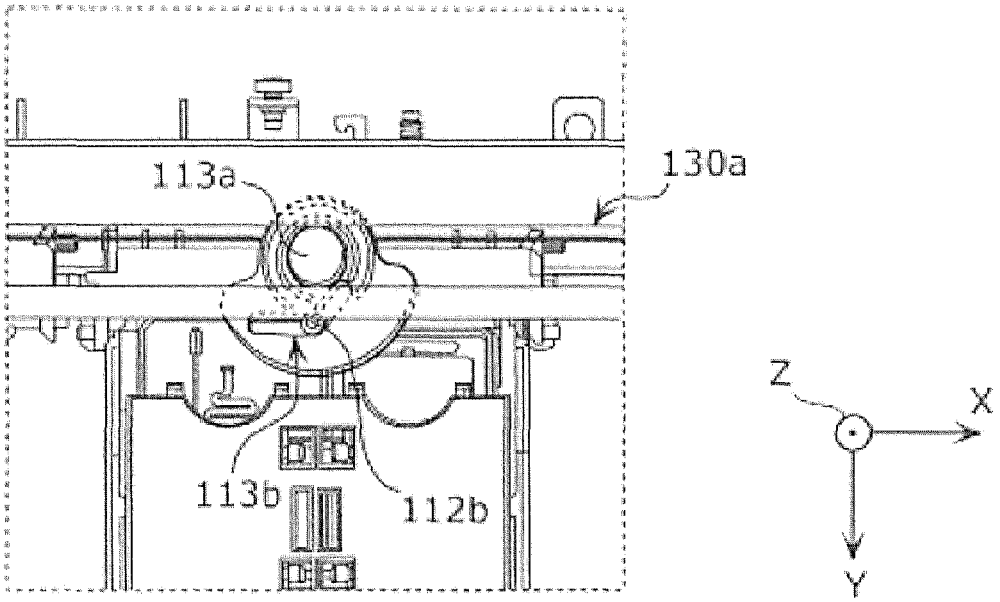
[FIG. 10B] This is a partial plan view illustrating the carriage vicinity in the second state.
Figure 10C:
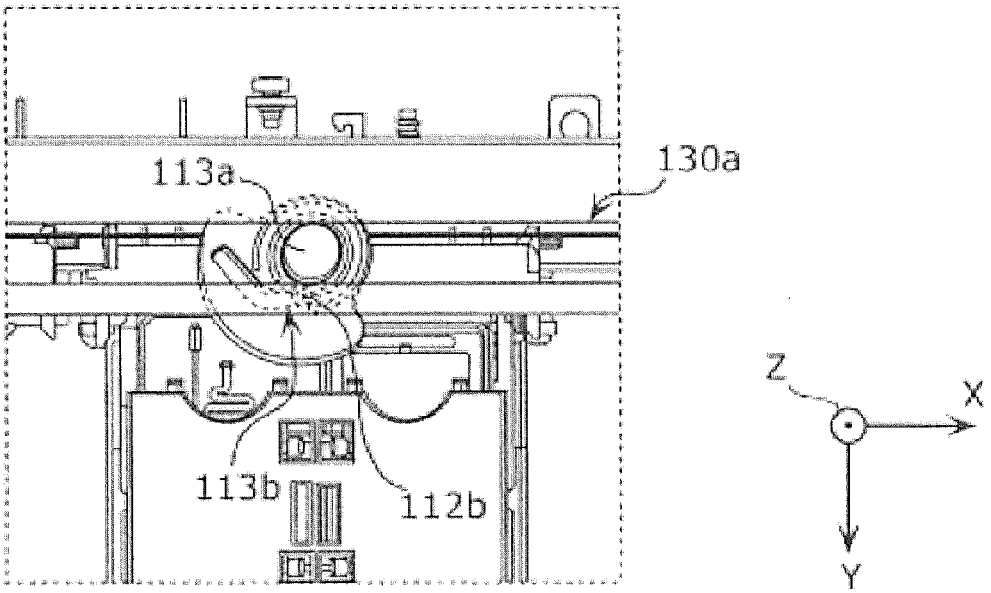
[FIG. 10C] This is a partial plan view illustrating the carriage vicinity in the third state.
Figure 11A:
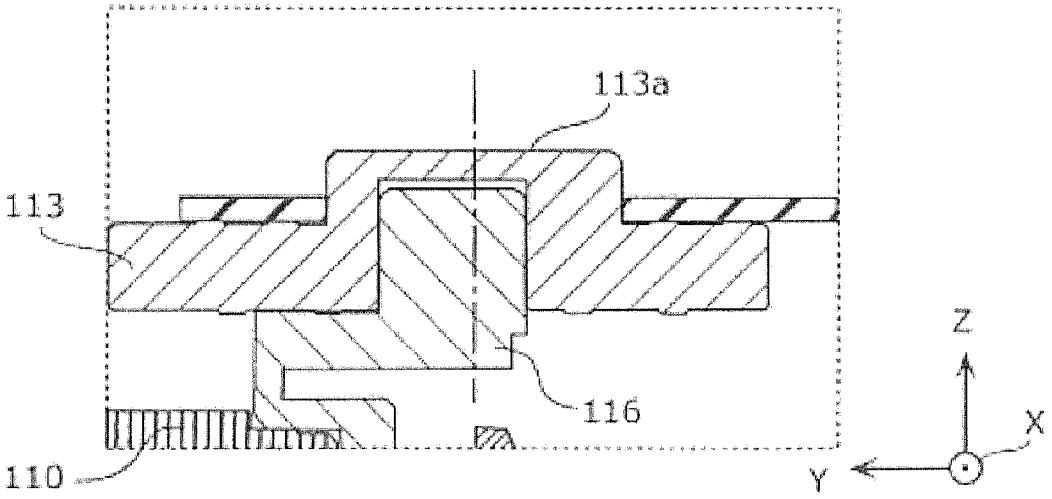
[FIG. 11A] This is a partial cross-sectional view illustrating a cam vicinity in the first state.
Figure 11B:
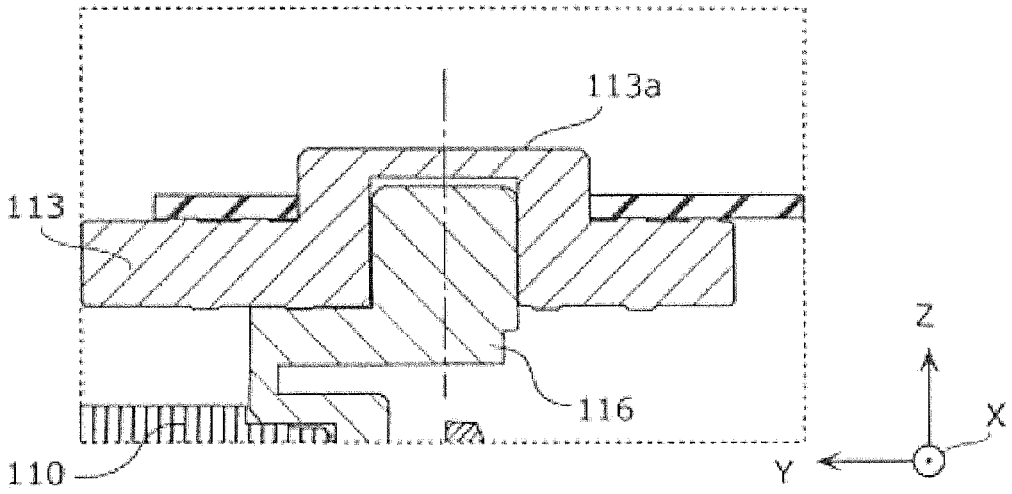
[FIG. 11B] This is a partial cross-sectional view illustrating the cam vicinity in the second state.
Figure 11C:
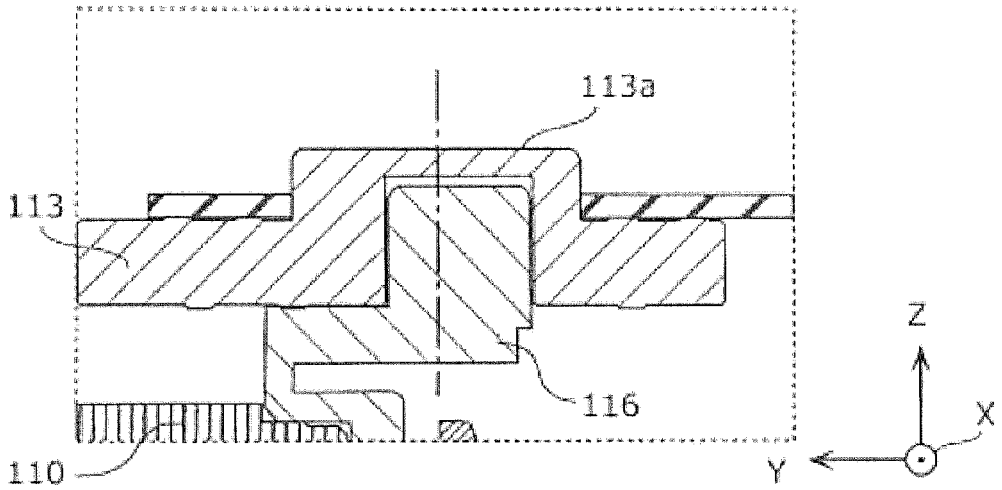
[FIG. 11C] This is a partial cross-sectional view illustrating the cam vicinity in the third state.
Figure 12A:
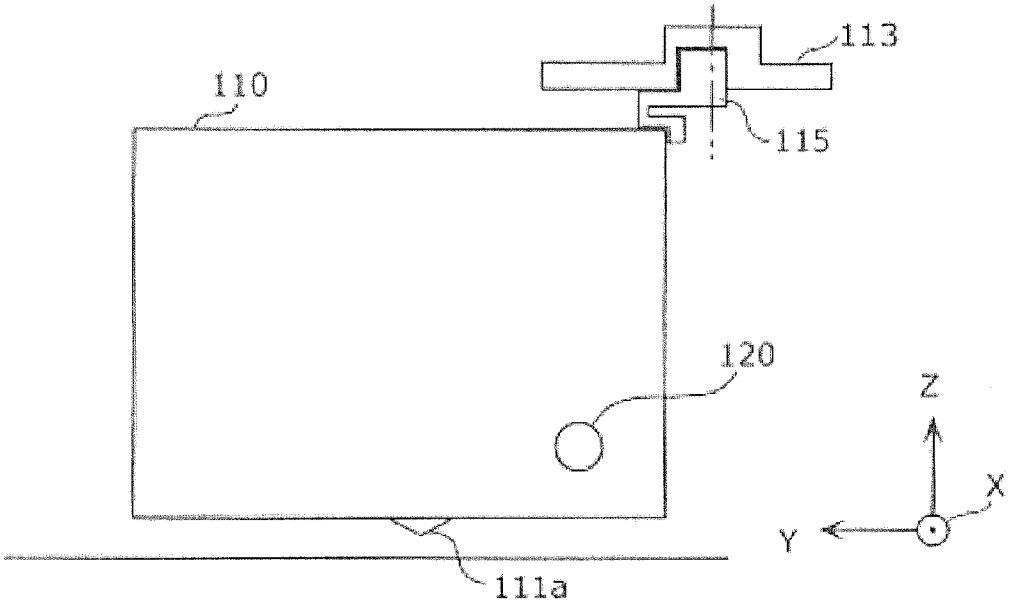
[FIG. 12A] This is a conceptual diagram illustrating an orientation of the carriage in the first state.
Figure 12B:
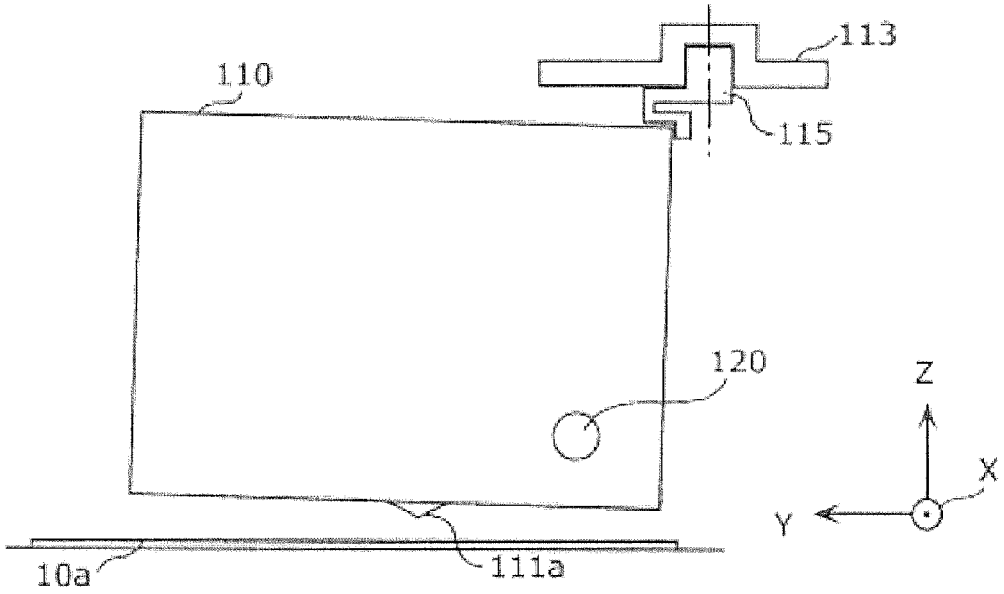
[FIG. 12B] This is a conceptual diagram illustrating an orientation of the carriage in the second state.
Figure 12C:
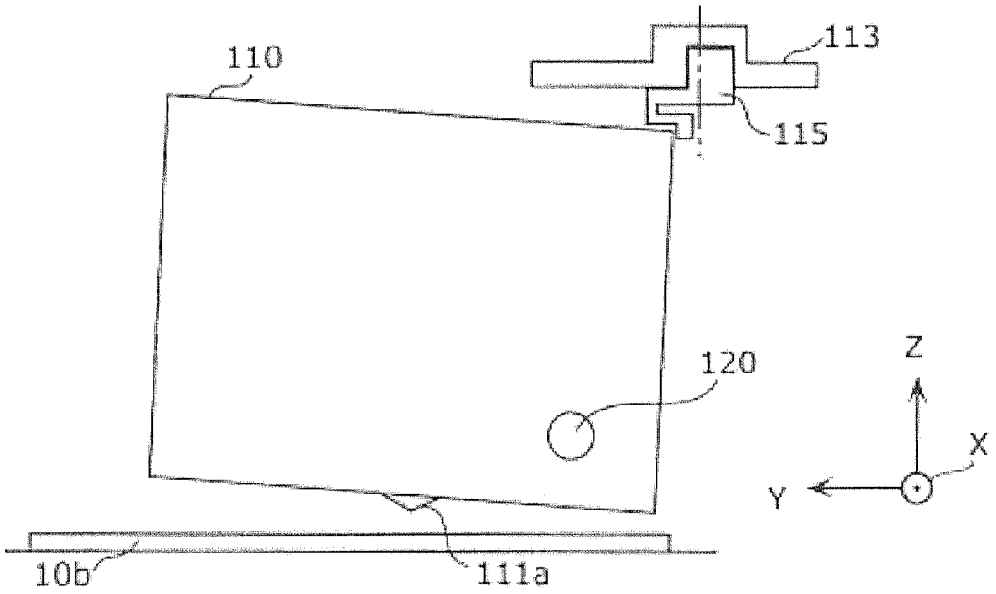
[FIG. 12C] This is a conceptual diagram illustrating an orientation of the carriage in the third state.

FIGS. 9A to 9C are partial side views illustrating the carriage vicinity in the first to third states. FIGS. 10A to 10C are partial plan views illustrating the carriage vicinity in the first to third states. FIGS. 11A to 11C are partial cross-sectional views illustrating a cam vicinity in the first to third states. FIGS. 12A to 12C are conceptual diagrams illustrating orientations of the carriage in the first to third states.

As illustrated in FIGS. 9A, 10A, and 11A, in the first state, the lever 112 is upright, and the upper end 112*b* of the lever 112 is away from the rotational center of the cam 113. Moreover, the connecting member 116 is connected more on a carriage side than the rotational center of the cam 113 and pushes out the carriage 110. As a result, the carriage 110 assumes an upright orientation as illustrated in FIG. 12A.

As illustrated in FIGS. 9B, 10B, and 11B, in the second state, the lower end 112*a* of the lever 112 is pushed up by the recording medium 10*a*. By this, the lever 112 rotates around the rotational shaft 112*c* and the inclination thereof changes. That is, the inclination of the lever 112 changes to an inclination corresponding to the first thickness of the recording medium 10*a*.

Furthermore, by the inclination of the lever 112 changing, the upper end 112*b* of the lever 112 approaches the rotational center of the cam 113 and rotates the cam 113. That is, the cam 113 rotates to a first rotational angle corresponding to the inclination of the lever 112.

By the cam 113 rotating in this manner, the connecting member 116 moves in a direction (negative direction of the Y axis) away from the carriage 110. The orientation of the carriage 110 changes as illustrated in FIG. 12B in conjunction with this movement of the connecting member 116. That is, the carriage 110 rotates around the guide shaft 120, and the nozzle 111*a* moves upward.

As illustrated in FIGS. 9C, 10C, and 11C, in the third state, the lower end 112*a* of the lever 112 is pushed up further by the recording medium 10*b*. By this, the lever 112 rotates around the rotational shaft 112*c* and inclines further than the second state. That is, the inclination of the lever 112 changes to an inclination corresponding to the second thickness of the recording medium 10*b*.

Furthermore, by the lever 112 inclining further, the upper end 112*b* of the lever 112 further approaches the rotational center of the cam 113 and further rotates the cam 113. That is, the cam 113 rotates to a second rotational angle corresponding to the inclination of the lever 112.

By the cam 113 rotating in this manner, the connecting member 116 moves further in the direction (negative direction of the Y axis) away from the carriage 110. The orientation of the carriage 110 changes as illustrated in FIG. 12C in conjunction with this movement of the connecting member 116. That is, the carriage 110 rotates around the guide shaft 120, and the nozzle 111*a* moves further upward. That is, fluctuation of the gap between the nozzle and the recording medium is suppressed.

According to one or more embodiments of the present invention, the inclination of the lever changes according to the thickness of the recording medium, the rotational angle of the cam changes according to the inclination of the lever, and the orientation of the carriage changes according to the rotational angle of the cam. That is, the orientation of the carriage can be changed according to the thickness of the recording medium, and the gap between the nozzle and the recording medium can be appropriately maintained even if the thickness of the recording medium changes. That is, the gap between the nozzle and the recoding medium can be adjusted by a simple configuration without using a drive source for adjusting the gap.

Furthermore, according to one or more embodiments of the present invention, the other end of the lever is inserted in the groove portion formed in the circumferential direction of the cam so the distance relative to the rotational center of the cam changes. This means that when the inclination of the lever changes, the other end of the lever attempts to move relatively along the groove portion to the position corresponding to the distance between the other end of the lever and the rotational center of the cam. At this time, because the other end of the lever cannot move freely along the groove portion, the cam rotates. In this manner, by the groove portion formed in the cam, the rotational angle of the cam can be changed according to the inclination of the lever by a simpler configuration, and the gap between the nozzle and the recording medium can be adjusted.

Furthermore, according to one or more embodiments of the present invention, the connecting member is connected to the position shifted from the rotational center of the cam. Therefore, if the cam rotates, the connecting member moves around the rotational center of the cam, and the orientation of the carriage can be changed.

Furthermore, according to one or more embodiments of the present invention, the rotational shaft portion of the cam is inserted in the groove extending in the predetermined direction formed in the upper surface of the frame so as to be movable in the predetermined direction and rotatable. Therefore, the cam can change the rotational angle according to the thickness of the recording medium while moving in the predetermined direction along with the carriage.

Furthermore, according to one or more embodiments of the present invention, the lever for adjusting the gap can be used to further detect the presence or absence of the recording medium.

(Modified Examples)

Embodiments of a printer according to one aspect of the present invention are described above, but the present invention is not limited to these embodiments. Various modifications conceived by persons skilled in the art applied to the embodiments are also included within the scope of the present invention.

For example, in the above embodiments, the printer comprises the connecting member connected to the cam but is not limited thereto. For example, a convex portion that is a convex portion with a circular cross section that protrudes to a lower surface (surface on an opposite side of the rotational shaft portion) of the main body portion of the cam and is eccentric relative to the rotational center may be integrally formed with the main body portion. This convex portion changes the orientation of the carriage.

A connection method of the connecting member and the carriage is not limited to the above embodiments. According to one or more embodiments, the connecting member and the carriage may be locked. Moreover, the connecting member may be integrally molded with the carriage.

In the above embodiments, the protruding portion for detecting the presence or absence of the recording medium is provided on the lever, but the protruding portion does not necessarily need to be provided. That is, the presence or absence of the recording medium does not necessarily need to be detected using the lever. Even in this situation, the gap between the recording medium and the nozzle can be adjusted.

In the above embodiments, the rotational shaft portion of the cam is inserted in the groove formed in the frame but is not limited thereto. For example, the rotational shaft portion of the cam may be inserted in a groove formed in a member other than the frame.

INDUSTRIAL APPLICABILITY

The present invention can be applied as, for example, an inkjet printer that performs printing by discharging ink onto a recording medium.

Although the disclosure has been described with respect to only a limited number of embodiments, those skilled in the art, having benefit of this disclosure, will appreciate that various other embodiments may be devised without departing from the scope of the present invention. Accordingly, the scope of the present invention should be limited only by the attached claims.

REFERENCE SIGNS LIST

10, 10*a*, 10*b* Recording medium
100 Printer
101 Casing
101*a* Rear panel
101*b* Front panel
102 Paper feed tray
103 Paper discharge tray
104 Operation unit
110 Carriage
111 Head
111*a* Nozzle

112 Lever
112*a* Lower end
112*b* Upper end
112*c* Rotational shaft
112*d* Protruding portion
113 Cam
113*a* Main body portion
113*b* Rotational shaft portion
113*c* Groove portion
113*d* Concave portion
114 Spring
115 Sensor
116 Connecting member
120 Guide shaft
130 Frame
130*a* Groove
140 Motor
150 Conveyance roller

What is claimed is:

1. A printer, comprising:
a carriage mounted with a head;
a thickness detecting unit that changes an inclination thereof based on a thickness between a surface of a paper feed tray of the printer and a top surface of a recording medium on the paper feed tray; and
a rotating unit that changes an orientation of the carriage based on the inclination of the thickness detecting unit.

2. The printer according to claim 1, wherein the thickness detecting unit is rotatably supported by the carriage and is configured such that the inclination relative to a vertical direction changes as the thickness increases.

3. The printer according to claim 2, wherein the vertical direction is a vertical direction of the top surface of the recording medium.

4. The printer according to claim 3, wherein
the rotating unit comprises a groove portion formed in a circumferential direction of the rotating unit; and
the thickness detecting unit comprises a first end and a second end, wherein the second end is inserted in the groove portion of the rotating unit so that a distance between the second end and the rotational center of the rotating unit changes based on the inclination of the thickness detecting unit.

5. The printer according to claim 4, further comprising:
a connecting member connected to the rotating unit at a position other than the rotational center of the rotating unit, wherein the connecting member changes the orientation of the carriage based on a rotational angle of the rotating unit.

6. The printer according to claim 5, wherein the connecting member comprises a circular concave portion at a position other than the rotational center of the rotating unit.

7. The printer according to claim 6, wherein the thickness detecting unit comprises a spring portion biased in a direction that presses the surface.

8. The printer according to claim 3, further comprising:
a discharge port that discharges the recording medium, wherein
the carriage is biased with the guide shaft as a fulcrum on a discharge port side so as to rotate in a direction in which a distance between the surface of the recording medium and a carriage bottom surface increases.

9. The printer according to claim 4, further comprising:
the guide shaft that guides movement of the carriage in a predetermined direction;
a frame that supports the guide shaft, wherein
a rotational shaft portion of the rotating unit is inserted in a groove formed in an upper surface of the frame in a predetermined direction so that the rotatable shaft portion is movable and rotatable in the predetermined direction.

10. The printer according to claim 1, further comprising:
the thickness detecting unit comprising a protrusion portion that protrudes in a direction orthogonal to a longitudinal direction of the thickness detecting unit; and
a sensor that detects a presence of the recording medium by sensing the protrusion portion in a predetermined location.

11. The printer according to claim 1, wherein the thickness detecting unit is a lever.

12. The printer according to claim 11, wherein the rotating unit is a cam.

13. The printer according to claim 1, wherein the rotating unit is a cam.

14. The printer according to claim 1, wherein
the carriage comprises a nozzle that discharges ink onto the recording medium,
the thickness detecting unit is a lever comprising a first end that contacts a surface of the recording medium,
the lever is disposed to cause an inclination of the lever relative to a vertical direction of the surface to change based on the thickness,
the rotating unit is a cam that changes an orientation of the carriage based on the inclination,
the cam comprises a groove portion formed in a circumferential direction of the cam, and
the lever further comprises a second end inserted in the groove portion of the cam and causes a distance between the second end and the rotational center of the cam to change based on the inclination.

15. The printer according to claim 14, further comprising:
a connecting member connected to the cam at a position other than the rotational center of the cam, wherein the connecting member changes the orientation of the carriage based on a rotational angle of the cam.

16. The printer according to claim 15, wherein the cam comprises a circular concave portion at a position other than the rotational center of the cam.

17. The printer according to claim 15, further comprising:
the guide shaft that guides movement of the carriage in a predetermined direction;
a frame that supports the guide shaft, wherein
a rotational shaft portion of the cam is inserted in a groove formed in an upper surface of the frame in a predetermined direction so that the rotatable shaft portion is movable and rotatable in the predetermined direction.

18. The printer according to claim 17, wherein
the lever comprises a protrusion portion that protrudes in a direction orthogonal to a longitudinal direction of the lever; and
the printer further comprises a sensor that detects a presence of the recording medium by sensing the protrusion portion in a predetermined location.

19. The printer according to claim 1, wherein
the carriage comprises a nozzle that discharges ink onto the recording medium,
the thickness detecting unit is a lever comprising a first end that contacts a surface of the recording medium,
the lever is disposed to cause an inclination of the lever relative to a vertical direction of the surface to change based on the thickness,
the rotating unit is a cam that changes an orientation of the carriage based on the inclination, the lever is rotatably supported by the carriage, and the inclination relative to the vertical direction of the surface increases as the thickness increases.

20. The printer according to claim 19, wherein the lever further comprises a spring portion biased in a direction that presses the surface.

* * * * *